US007504776B2

(12) United States Patent
Jang

(10) Patent No.: US 7,504,776 B2
(45) Date of Patent: Mar. 17, 2009

(54) PLASMA DISPLAY PANEL

(75) Inventor: Tae-Woong Jang, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 662 days.

(21) Appl. No.: 11/139,049

(22) Filed: May 27, 2005

(65) Prior Publication Data

US 2006/0001371 A1 Jan. 5, 2006

(30) Foreign Application Priority Data

Jun. 30, 2004 (KR) ..... 10-2004-0050675

(51) Int. Cl.
*H01J 17/49* (2006.01)

(52) U.S. Cl. ..... 313/585; 313/582; 445/24

(58) Field of Classification Search ..... 313/582–587; 315/169.1, 169.4; 345/37, 41, 60, 71
See application file for complete search history.

(56) References Cited

U.S. PATENT DOCUMENTS

| | | | | |
|---|---|---|---|---|
| 6,522,072 | B1 | 2/2003 | Yura et al. | |
| 6,646,375 | B1 * | 11/2003 | Nagano | 313/582 |
| 6,670,754 | B1 | 12/2003 | Murai et al. | |
| 6,747,409 | B1 | 6/2004 | Han et al. | |
| 6,884,142 | B2 * | 4/2005 | Kang et al. | 445/25 |
| 2002/0195939 | A1 * | 12/2002 | Okigawa et al. | 313/584 |

FOREIGN PATENT DOCUMENTS

| | | | |
|---|---|---|---|
| CN | 1506997 | A | 6/2004 |
| JP | 05-114362 | A | 5/1993 |
| JP | 10-149774 | A | 6/1998 |
| JP | 2000-243297 | A | 9/2000 |
| JP | 2001-189134 | | 7/2001 |
| JP | 2003-303551 | | 10/2003 |
| KR | 2001-0072239 | | 7/2001 |

OTHER PUBLICATIONS

Patent Abstracts of Japan, Publication No. 2001-189134, dated Jul. 10, 2001, in the name of Gun Paku Fun.

* cited by examiner

*Primary Examiner*—Donald L Raleigh
(74) *Attorney, Agent, or Firm*—Christie, Parker & Hale, LLP

(57) ABSTRACT

A plasma display panel includes a pair of substrates that are arranged opposite to each other, each having a display region to display an image and a non-display region not to display an image. Barrier ribs are located in a space between the substrates for forming a plurality of discharge cells. Phosphor layers are formed in the discharge cells. Address electrodes are formed on one of the substrates. First and second electrodes are formed on the other substrate so as to extend in a direction orthogonal to the address electrodes and are spaced apart from each other to form discharge gaps in the discharge cells. The first and second electrodes extend into the non-display region with different lengths from each other.

11 Claims, 4 Drawing Sheets

PLASMA DISPLAY PANEL

CROSS-REFERENCE TO RELATED APPLICATION

This application claims priority to and the benefit of Korean Patent Application 10-2004-0050675 filed in the Korean Intellectual Property Office on Jun. 30, 2004, the entire content of which is incorporated herein by reference.

BACKGROUND OF THE INVENTION

1. Field of the Invention

The present invention relates to a plasma display panel (PDP), and more particularly, to a PDP capable of improving the electrode structure to increase the brightness and of stabilizing charge.

2. Description of the Related Art

A PDP is a display in which discharge cells and a pair of sustaining electrodes provided so as to correspond to each discharge cell are arranged between a pair of substrates, and phosphors corresponding colors including R (red), G (green), and B (blue) are excited with ultraviolet rays generated in the process of plasma discharge to display images.

Typically, a display electrode is composed of a transparent electrode so as not to intercept light radiated from the substrate. However, since the transparent electrode itself has the high resistance, the display electrode is formed with composition of a metallic electrode and the transparent electrode in order to complement conductivity.

In this case, the transparent electrode is formed of a material, such as an ITO (indium tin oxide) or $SnO_2$, and the metallic electrode is formed of a thin film made of Ag, a thin film consisting of three layers of Cr/Cu/Cr, and a thin film consisting of two layers of Al/Cr.

The metallic electrode is typically formed on a glass substrate by a photo etching method and a liftoff method, and then the transparent electrode is formed by the photo etching method and the liftoff method.

As such, according to the conventional approach the work process is very complicated and thus, the cost of manufacturing the panel increases. Further, since the transparent electrode is expensive, this also increases the manufacturing cost.

For this reason, in recent years efforts have been to form the display electrode with only the metallic electrode without using the transparent electrode. As one example of such a display electrode approach, a plasma display panel is disclosed in U.S. Pat. No. 6,522,072. While manufacturing cost can be reduced as compared to the above-mentioned structure of the electrode, there is still a problem in that the display electrode formed with only the metal electrode lowers the opening ratio of the panel, which decreases the brightness.

As an alternative to solve the above-mentioned problems, a method has been considered in which it makes a distance between two metals located with the discharge gap interposed therebetween increase. However, according to such a method, there are still problems in that the discharge voltage increases and the discharge becomes unstable.

SUMMARY OF THE INVENTION

In accordance with the present invention, a plasma display panel capable of guiding stable discharge is provided to achieve high definition display without a transparent electrode.

According to one aspect of the present invention, a plasma display panel includes a pair of substrates that are arranged opposite to each other, each having a display region to display an image and a non-display region not to display an image. Barrier ribs are located in a space between the substrates for forming a plurality of discharge cells. Phosphor layers are formed in the discharge cells. Address electrodes formed on one of the substrates. First and second electrodes are formed on the other substrate so as to extend in a direction orthogonal to the address electrodes and are spaced apart from each other to form discharge gaps in the discharge cells. The first and second electrodes extend into the non-display region with different lengths from each other.

In exemplary embodiments the discharge gaps may be formed differently by the first and second electrodes in discharge cells of the display region and discharge cells of the non-display region.

Further, in exemplary embodiments each of the first and second electrodes may be composed of a plurality of line portions which are spaced apart from each other.

Further, in exemplary embodiments the plurality of line portions may include first line portions with the discharge cells interposed therebetween. Second line portions may be arranged opposite to each other in the discharge cell to form the discharge gap. Third line portions may be located between the first and second line portions.

Further, in exemplary embodiments the plasma display panel may include connecting portions that connect the first and second line portions through the third line portions.

Further, in exemplary embodiments the line portions and the connecting portions may be formed of metallic electrodes.

Further, in exemplary embodiments the second line portions constituting one of the first and second electrodes may extend into the non-display region by a shorter distance than those of the first and third line portions.

Further, in exemplary embodiments the discharge cell formed in the non-display region may include a dummy cell, and one of the first and second electrodes may have its one end located in the dummy cell.

According to another aspect of the present invention, the first and second electrodes are symmetrically formed in the non-display region.

According to still another aspect of the present invention, a method is provided wherein the first and second electrodes are extended from the display region into the non-display region at lengths different from each other such that a discharge gap difference is provided between the first and second electrodes in the non-display region.

DETAILED DESCRIPTION

Figure 1:
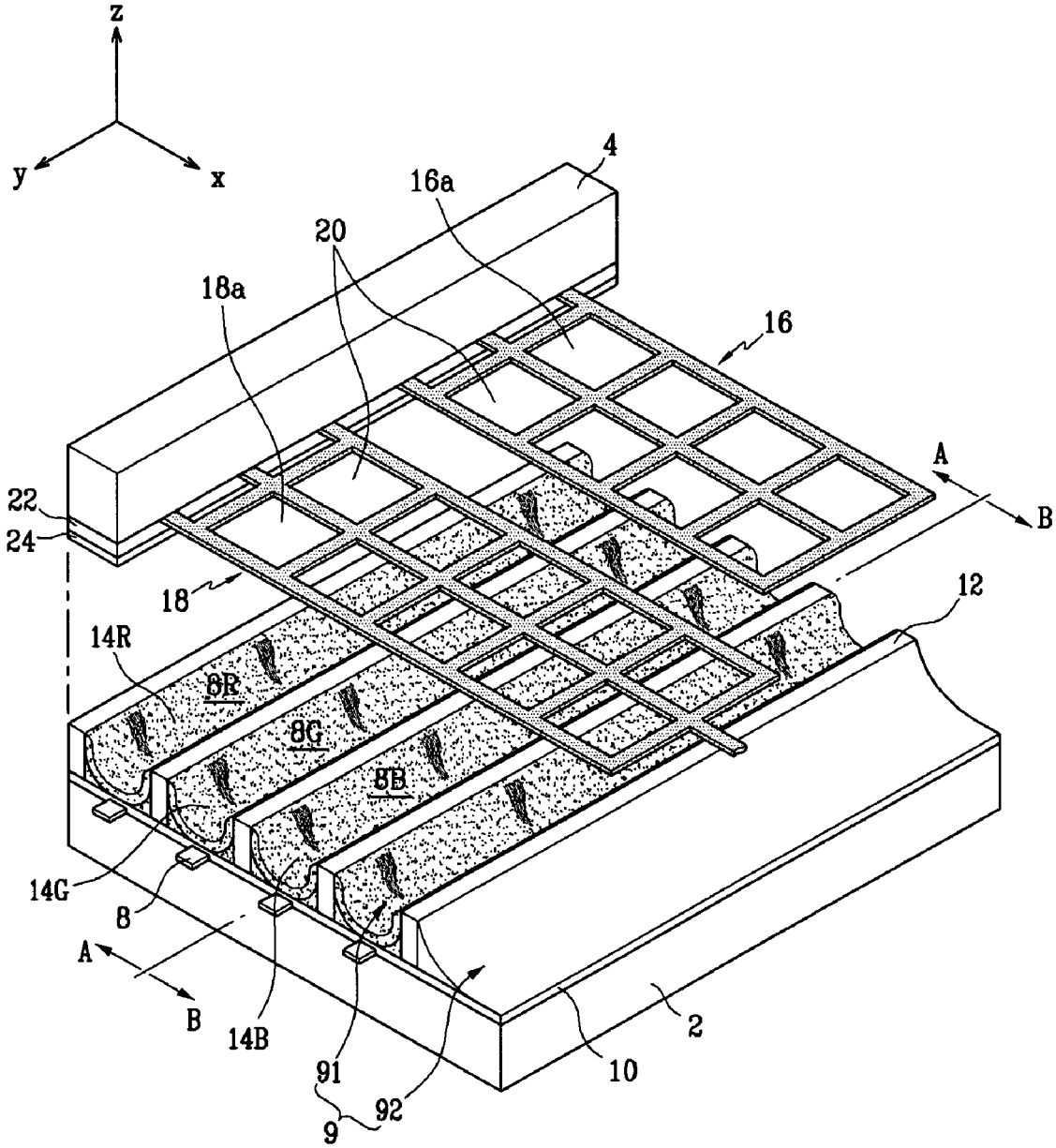
FIG. 1 is a partial exploded perspective view showing a plasma display panel according to a first exemplary embodiment of the present invention.

Referring to FIG. 1, the PDP according to the present embodiment has a structure such that a pair of substrates 2 and 4 are disposed opposite to each other at a predetermined gap, and discharge cells 8R, 8G, and 8B corresponding to red (R), green (G), and blue (B) cells defined by barrier ribs 12 are provided between the pair of substrates. Address electrodes 8 are arranged along a width-wise direction (an X-axis direction in FIG. 1) of each of the discharge cells 8R, 8G, and 8B at a predetermined gap between adjacent address electrodes.

The address electrodes 8 are provided along a Y-axis direction on the substrate 2. Dielectric layer 10 is formed over the entire surface of the substrate 2 so as to cover the address electrodes 8.

The barrier ribs 12 are formed on the dielectric layer 10, and phosphor layers 14R, 14G, and 14B corresponding to red (R), green (G), and blue (B) layers are formed over surfaces of the barrier ribs 12 and the dielectric layer 10. Each barrier rib 12 is arranged between two adjacent address electrodes 8.

The barrier ribs 12 are arranged along the Y-axis direction in a stripe pattern so as to be substantially parallel to the adjacent barrier ribs. However, the present invention is not limited to such a stripe pattern. For example, the barrier ribs 12 may have the structure that the discharge cells 8R, 8G, and 8B are arranged in a matrix formed by first barrier ribs in the X-axis direction and by second barrier ribs in the Y-axis direction, or may have a delta structure such that the discharge cells 8R, 8G, and 8B are arranged in a triangular form.

In addition, on the substrate 4 which is opposite to the substrate 2, display electrodes 20 composed of scanning electrodes 16 and sustaining electrodes 18 are formed in which they are arranged in a direction orthogonal to the address electrode 8 direction. An MgO protecting film 24 and a dielectric layer 22 are laminated over the entire inner surface of the substrate 4 so as to cover the display electrodes 20.

According to the present embodiment, the display electrodes 20 are formed of only a metallic conductive material and thus has empty spaces 16*a* and 18*a* formed therein. The structure of the electrodes according to the present embodiment will be described in more detail below with reference to FIGS. 3 and 4.

When bonding the two substrates 2 and 4, the address electrodes 8 and the display electrodes 20 cross each other to form the discharge cell regions 8R, 8G, and 8B. In addition, each discharge cell is filled with a discharge gas (mainly, a mixed gas of Ne—Xe) for guiding the discharge of vacuum ultraviolet (VUV) rays through plasma discharge.

With the above-mentioned structure, the panel according to the present embodiment causes reset discharge between the display electrodes 20 to be generated to reset a charge state in the discharge cells. In addition, the address voltage is applied between the address electrode 8 and the scanning electrode 16 to charge the wall charge. As a result, discharge cells for displaying an image are selected. As such, after the discharge cell is selected, an alternating pulse is applied to the display electrode to initiate the drive for image display.

Figure 2:
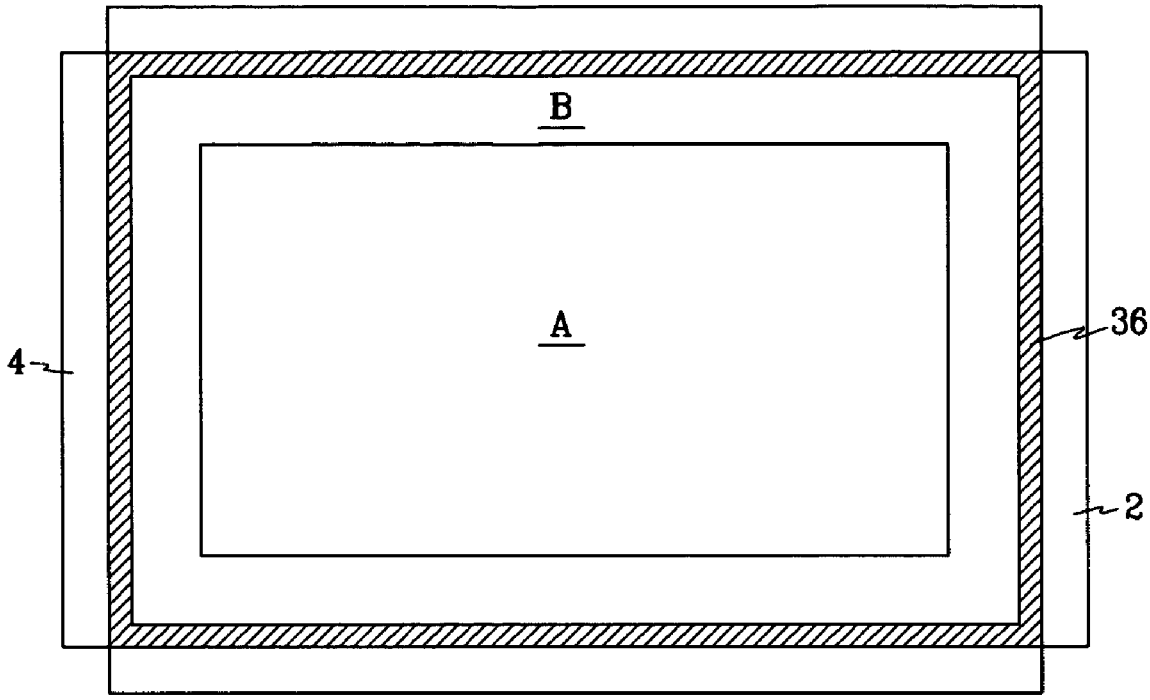
FIG. 2 is a schematic plan view illustrating a display region and a non-display region of the plasma display panel according to the first exemplary embodiment according to the present invention.

Referring to FIG. 2, the panel has a display region A in which an image is displayed and a non-display region B in which an image is not displayed. The discharge cells located in the display region A display images using phosphor layers coated on the barrier ribs and inside the discharge cells and discharge gases. That is, applying the voltage through the respective electrodes 16 and 18 causes plasma discharge to be generated to excite discharge gases, so that the VUV rays are generated. Then, the VUV rays excite the phosphor layers, so that an original color is displayed for each discharge cell.

On the other hand, the non-display region B is a margin region necessary for a work process, and the discharge region, such as the dummy cell 91 (see FIGS. 3 and 4), may be prepared in the non-display region B. However, the non-display region is a region which does not substantially display images. Further, in the present invention, the dummy cell serves as a discharge cell formed in the non-display region and does not substantially display the images. Therefore, the dummy cell may be formed or not formed in the non-display region B depending on the work process. A sealant 36 seals the space between the substrates 2 and 4.

The structure of the electrode according to the present embodiment will now be described in more detail wherein the display electrode 20 has the structure of a non-transparent (ITO-less) electrode that it is not composed of a transparent electrode, but composed of a metallic electrode.

Figure 3:
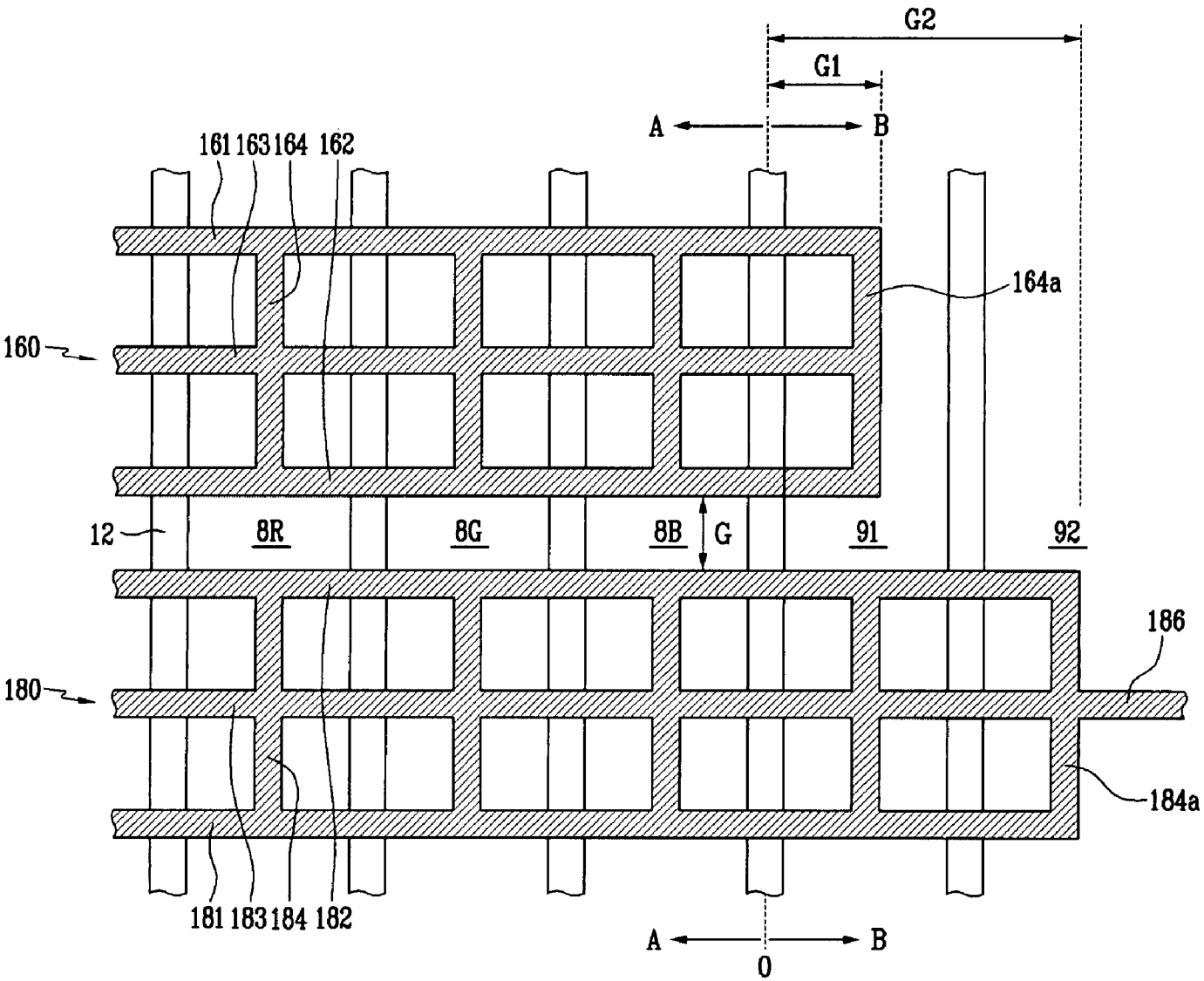
FIG. 3 is a diagram showing arrangement relationships between electrodes and barrier ribs shown in FIG. 1.

FIG. 3 is a diagram illustrating the structure of the electrode according to the present embodiment, in which it shows the arrangement structure of the display electrodes 160, 180 according to the barrier ribs at the boundary 0 between the display region A and the non-display region B. The display electrodes 160, 180 provided in the display region A according the present embodiment includes a pair of first line portions 161 and 181 which are arranged opposite to the discharge cells and are arranged parallel to each other and a pair of second line portions 162 and 182 which are located between the first line portions 161 and 181 and are arranged opposite to each other to form discharge gaps G in the discharge cells and form an opposed discharge of the initial discharge in accordance with the voltage pulse applied to each electrode.

The initial opposed discharge leads to a surface discharge while diffusing between the first line portions 161 and 181. When distances are excessively large between the first line portions 161 and 181 and the second line portions 162 and 182, it is difficult for the discharge to be diffused. Therefore, a pair of third line portions 163 and 183 may be further formed between the first line portions 161 and 181 and the second line portions 162 and 182 so as to guide the discharge diffusion.

In this case, the first to third line portions 161 to 163 and 181 to 183 extend in a direction orthogonal to the address electrodes 8 and spaced apart from each other.

As a result, the opposed discharge formed between the second line portions 162 and 182 leads to surface discharge while diffusing between the first line portions 161 and 181 via the third line portions 163 and 183.

The display electrode 160, 180 may have connecting portions 164 and 184 for connecting the first line portions 161 and 181, the second line portions 162 and 182, and the third line portions 163 and 183 formed in the respective discharge cells.

As described above, the region of the panel according to the present embodiment is divided into the two regions, that is, the display region A and the non-display region B formed along the boundary 0. In this case, in an exemplary embodiment, the electrodes are formed in the non-display region B. In the following description, a case in which the electrode has three line portions will be described, but the present invention is not limited thereto.

As shown in FIG. 3, the first to third line portions provided in the display region A extend to the non-display region B, so that the electrodes provided in the non-display region B form the respective scanning electrodes 160 and the sustaining electrodes 180.

The respective electrodes are led out from the panel in different directions and are connected to driving units (not shown) for driving the electrodes. The driving units are fixed on the panel in a direction of a rear surface thereof. In FIG. 3, the scanning electrode 160 is led out leftward (not shown), and the sustaining electrode 180 is led out rightward through a leading line 186 at an outermost connecting portion 184*a* connects the respective line portions 181 to 183.

The respective electrodes provided in the non-display region B using the boundary 0 as a reference may have different lengths G1 and G2. Specifically, the respective line portions 161 to 163 constituting the scanning electrode 160 passes through the boundary 0 to extend into the non-display region B by a length G1, and the respective line portions 181 to 183 constituting the sustaining electrode 180 passes through the boundary 0 to extend into the non-display region B by a length G2 longer than the length G1.

When the non-display region B includes a dummy cell 91, in an exemplary embodiment the scanning electrode 160 may extend only up to the inside the dummy cell 91. Therefore, the outermost connecting portion 164*a* which connects ends of the respective line portions 161 to 163 of the electrode is located in the dummy cell 91.

According to the structure, there is the length difference of G2−G1 between the two electrodes 160 and 180. As a result, a discharge gap difference is generated between the two electrodes 160 and 180. As such, if the discharge gap difference is generated, it leads to reduction of an electric charge generated between the two electrodes 160 and 180. This is because an electric potential decreases around the discharge gap G. As a result, since the voltage sufficient to generate the opposed discharge generated around the discharge gap is not formed, it is possible to prevent the abnormal discharge from occurring in the non-display region.

Figure 4:
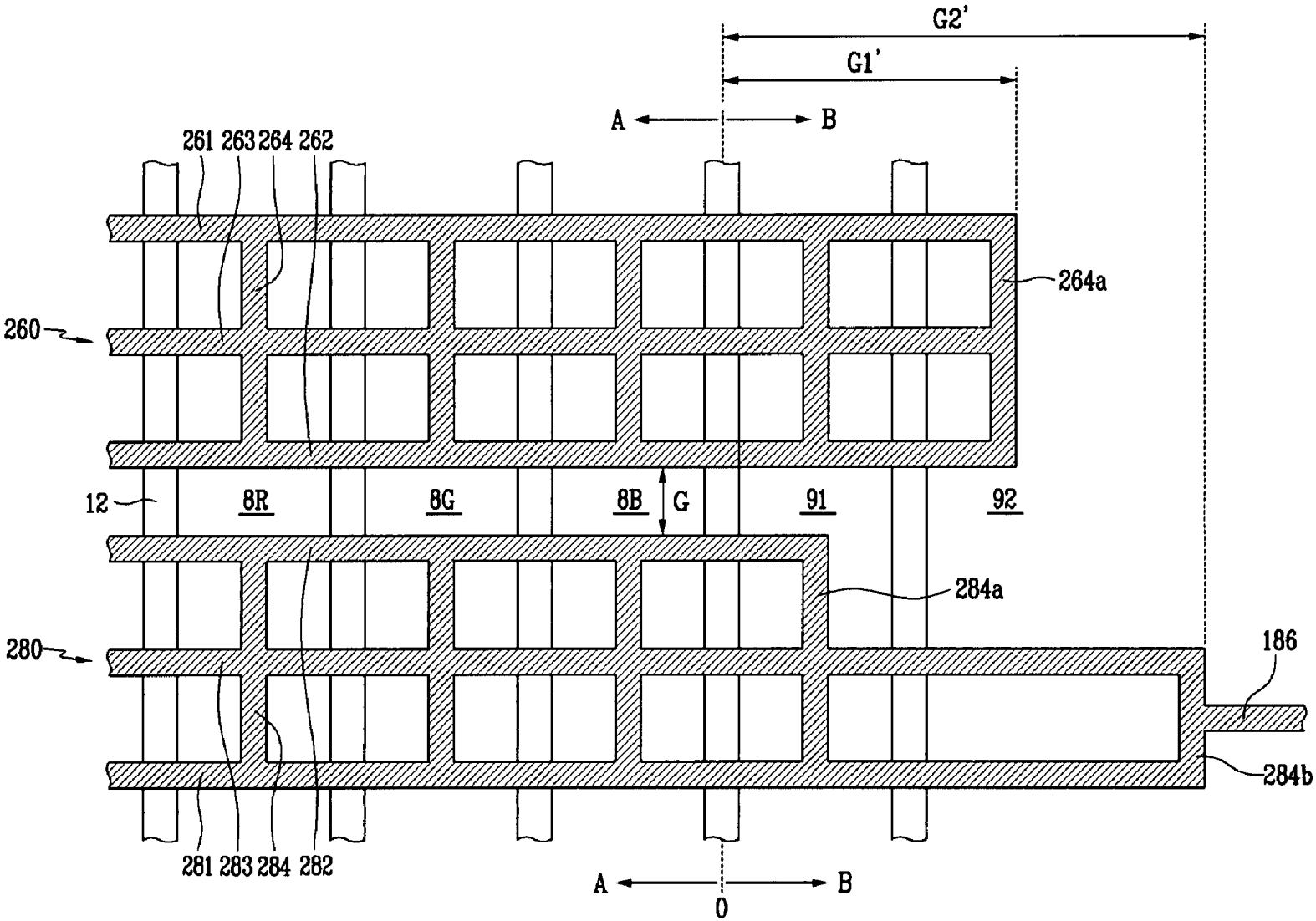
FIG. 4 is a diagram showing arrangement relationships between electrodes and barrier ribs in a plasma display panel according to a second exemplary embodiment of the present invention

Referring now to FIG. 4, there is shown the relationships between the electrode arrangement and the barrier rib arrangement in a plasma display panel according to a second embodiment of the present invention. In the second embodiment, each scanning electrode 260 and each sustaining electrode 280 are formed with a plurality of line portions 261 to 263 and 281 to 283 respectively which extend at a long length in a direction orthogonal to an address electrode 8 in the display region A.

As described above, connecting portions 264 and 284 for connecting the respective line portions of the electrodes 260 and 280 may be further provided along discharge cells 8R, 8G, and 8B.

The scanning electrode 260 and the sustaining electrode 280 which are provided in the display region A and have the above-mentioned structure extend into the non-display region B by lengths G1' and G2' from the boundary 0, respectively. Ends of the scanning electrodes 260 are connected to each other through a connecting portion 264*a* which connects the respective line portions 261 to 263 at an outermost portion of the electrode.

In the sustaining electrode 280, in a state in which the respective line portions 281 to 283 extends at the same location as the display electrode 260, that is, extends in the non-display region B by the length G1', an end of the second line portion 282, which is arranged opposite to the second line portion 262 of the display electrode 260 to form discharge gaps, is connected to the other line portions 281 and 283 through the outermost connecting portion 284*a*.

In addition, the first line portion 281 and the third line portion 283 further extend into the non-display region by a length G2'-G1' in a direction orthogonal to the address electrode 8 (rightward in FIG. 4). In a state in which ends of the first and third line portions 281 and 283 are connected to each other through the connecting portion 284*b*, they are led out from the panel through the leading line 286.

Therefore, a length difference of G2'−G1' occurs between the two electrodes 260 and 280 which are opposite to each other in the non-display region B. As a result, as described above, it is possible to prevent the abnormal discharge from generating in the non-display region B.

According the present invention, since problems such as the occurrence of the abnormal discharge in the non-display region can be resolved, it is possible to provide a panel capable of achieving high definition display compared to the prior art.

Further, since the electrodes are constructed in a state in which empty spaces are partially formed, it is possible to improve an opening ratio of the panel to increase the light-emitting brightness as compared to the prior art.

Furthermore, since the respective line portions are separately provided, even though the disconnection is generated at any electrode, another line portion compensates for the disconnected electrode. That is, even though the defect occurs due to the electrode disconnection of the panel, another line portion compensates for the disconnected line portion, so that it is possible to sustain the light-emitting efficiency and the light-emitting brightness as they are.

Although the present invention has been described with reference to a few of embodiments and the accompanying drawings, the present invention is not limited thereto, and it would be appreciated by those skilled in the art that changes may be made without departing from the principles and spirit of the invention and the scope of which is defined in the claims and their equivalents.

What is claimed is:

1. A plasma display panel comprising:

a pair of substrates arranged opposite to each other, each having a display region and a non-display region;

barrier ribs in a space between the substrates forming a plurality of discharge cells;

a phosphor layer in each of the discharge cells;

address electrodes on one of the substrates; and first electrodes and second electrodes on the other substrate extending in a direction orthogonal to the address electrodes and spaced apart from each other to form discharge gaps in the discharge cells, wherein the first electrodes and the second electrodes extend into the non-display region at lengths different from each other, wherein each of the first electrodes and the second electrodes includes a plurality of line portions spaced apart from each other, wherein the plurality of line portions include:

first line portions with the discharge cells interposed therebetween;

second line portions opposite to each other in the discharge cells to form the discharge gaps, and wherein the second line portions of the first electrodes extend into the non-display region by a distance shorter than a distance the second line portions of the second electrodes extend into the non-display region.

2. The plasma display panel of claim 1, wherein the discharge gaps are formed differently by the first electrodes and the second electrodes in discharge cells of the display region and discharge cells of the non-display region.

3. The plasma display panel of claim 1, wherein the plurality of line portions include third line portions between the first line portions and the second line portions.

4. The plasma display panel of claim 3, further comprising connecting portions each connecting a first line portion and second line portion through a third line portion.

5. The plasma display panel of claim 4, wherein the connecting portions are formed of metallic electrodes.

6. The plasma display panel of claim 1, wherein the discharge cell in the non-display region includes a dummy cell, one of the first electrodes and the second electrodes having one end located in the dummy cell.

7. A method of preventing abnormal discharge in a non-display region of a plasma display panel, the plasma display panel having a pair of substrates opposite to each other, each having a display region and a non-display region, the non-display region being exterior to the display region, barrier ribs in a space between the substrates forming a plurality of discharge cells in the display region, a phosphor layer in each of the discharge cells, address electrodes on one of the substrates, first electrodes and second electrodes on the other substrate extending in a direction orthogonal to the address electrodes and spaced apart from each other to form discharge gaps in the discharge cells, the method comprising:

extending the first electrodes and the second electrodes from the display region into the non-display region at lengths different from each other such that a discharge gap difference is provided between the first electrodes and the second electrodes in the non-display region, wherein each of the first electrodes and the second electrodes includes a plurality of line portions spaced apart from each other, wherein the plurality of line portions include:

first line portions with the discharge cells interposed therebetween:

second line portions opposite to each other in the discharge cells to form the discharge gaps, and wherein the second line portions of the first electrodes extend into the non-display region by a distance shorter than a distance the second line portions of the second electrodes extend into the non-display region.

8. The plasma display panel of claim 7, wherein the plurality of line portions include third line portions between the first and second line portions.

9. The method of claim 8, further comprising connecting by a connecting portion a first line portion and second line portion through a third line portion.

10. The method of claim 9, further comprising forming connecting portions as metallic electrodes.

11. The method of claim 7, further comprising forming a dummy cell in the non-display region and locating one end of one of the first electrodes and the second electrodes in the dummy cell.

* * * * *